United States Patent [19]

Heimberger

[11] 4,064,602

[45] Dec. 27, 1977

[54] WARP-KNIT SLIDE FASTENER STRINGER HALF AND METHOD OF MAKING SAME

[75] Inventor: Helmut Heimberger, Locarno, Switzerland

[73] Assignee: Optilon W. Erich Heilmann GmbH, Cham, Switzerland

[21] Appl. No.: 728,032

[22] Filed: Sept. 30, 1976

[30] Foreign Application Priority Data

Apr. 7, 1976 Germany ..... 2614932

[51] Int. Cl.[2] ..... A44B 19/00

[52] U.S. Cl. ..... 24/205.1 C; 66/195

[58] Field of Search ..... 66/190–195; 24/205.1 C, 205.16 C, 205.13, 205

[56] References Cited

U.S. PATENT DOCUMENTS

| | | | |
|---|---|---|---|
| 3,222,893 | 12/1965 | Busch et al. | 66/192 |
| 3,448,595 | 6/1969 | Baltzer et al. | 66/195 |
| 3,762,002 | 10/1973 | Frolich et al. | 24/205.1 C |
| 3,840,946 | 10/1974 | Frolich et al. | 24/205.1 C |
| 3,881,473 | 5/1975 | Corui et al. | 66/195 |
| 3,974,550 | 8/1976 | Fujisaki et al. | 24/205.1 C |

*Primary Examiner*—Ronald Feldbaum
*Attorney, Agent, or Firm*—Karl F. Ross

[57] ABSTRACT

A slide-fastener stringer half comprises an elongated warp-knitted tape having a pair of opposite longitudinally extending edges and a pair of opposite faces and formed with a plurality of longitudinally extending parallel wales. This tape is knit with a plurality of warp yarns each forming a respective longitudinally extending loop chain extending transversely over two respective wales or needles, a first group of weft yarns laid into and each extending over three of the wales, and a second group of weft yarns laid into and each extending over one of the wales. A continuous monofilamentary coupling element having a succession of turns and lying on one face of the tape along one edge thereof is secured to the tape by stitching which overlies the turns, extends through the tape, and has a needle thread on the other face of the tape between two of the wales at the edge.

11 Claims, 4 Drawing Figures

WARP-KNIT SLIDE FASTENER STRINGER HALF AND METHOD OF MAKING SAME

CROSS-REFERENCE TO RELATED APPLICATIONS

This application is related to my concurrently filed copending and commonly assigned patent applications Ser. No. 728,136; Ser. No. 728,134; Ser. No. 728,033; Ser. No. 728,135; Ser. No. 728,034; Ser. No. 728,133; Ser. No. 728,035; Ser. No. 728,031 and Ser. No. 728,132.

FIELD OF THE INVENTION

The present invention relates to a slide-fastener stringer half and method of making same. More particularly this invention concerns such a stringer half comprising a warp-knit tape to which is stitched a monofilamentary synthetic-resin coupling element.

BACKGROUND OF THE INVENTION

A slide-fastener stringer half is known, having a support tape which is formed of warp-knitted goods having wales running longitudinally of the tape and courses extending transversely. Each wale is the product of a respective needle of the knitting machine, even though at times the wales do not represent ridges or formations on the surface but are smooth therewith. Customarily such an arrangement is made with warp yarns by which is meant filaments extending mainly longidudinally, that form respective chains of loops or pillars extendng longitudinally of the fabric, and of weft filaments which extend mainly transversely, being laid into the chains of loops being formed by the warp filaments.

In the known tapes (see especially German open application DT-OS 2,016,141 and U.S. Pat. No. 3,708,836) the weft filaments are laid in over four needles, or over four wales of the tape so as to give this tape good transverse dimensional stability and to improve the longitudinal dimensional stability mainly determined by the warp yarns.

More particularly, in this arrangement the wales are of the single-bar type formed as warp chains which are bridged only by the filler or weft. As indicated the sole connecting threads or yarns between the warp chains are the laid-in weft filaments or yarns which extend over four warp chains each so that four such weft inlays fill each warp loop to provide the transverse stability of the tape (stability in the plane of the tape perpendicular to the warp chains) and, in addition, prevent longitudinal extension and contraction (change of dimension in the plane of the tape parallel to the warp chains). The dimensional stability is most pronounced if the tapes are composed of synthetic-resin yarn which has been thermofixed, i.e. subjected to a heating or ultrasonic treatment which relaxes internal stresses within the yarn.

The advantage of single-bar warp chains, i.e. individual spaced apart wales of loops interconnected only by the weft, is that channels are formed between wales so that the row of stitching for attaching the coupling element can lay along one of these channels or valleys.

Needle patterns are typically used in the needle art wherein the needles are so set up as if it was never the same needle, but as if the necessary new needle row for the formation of another stitch row always lay above the preceding row. This described system is, however, not as efficient as could be desired, since the support tapes for such slide-fastener stringer halves are not made by using the full capacity of modern knitting machines. Further, although stitching along between a pair of wales to attach the coupling element does not pose a problem, it is desirable to improve the stitching speed.

OBJECTS OF THE INVENTION

It is therefore an object of the present invention to provide an improved slide-fastener stringer half and method of making same.

Another object is to provide such a stringer half which is made using all of the capacity of a modern knitting machine.

Yet another object is to provide such a stringer half which has good dimensional stability, yet which can be sewn to the coupling element at high speed.

SUMMARY OF THE INVENTION

These objects are attained according to the present invention in a slide-fastener stringer half of the above-described general type wherein the warp yarns each form respective longitudinally extending loop chains which extend transversely over two respective wales. There is a first group of weft yarns laid into and each extending over only three of the wales and a second group of weft yarns laid into and each extending over only one of the wales. The continuous monofilamentary coupling element having a succession of turns lies on one face of the tape along the edge thereof and is secured in this position by stitching which overlies the turns of the element, extends through the tape, and has a needle thread on the other face of the tape between two of the wales at the edge. Such an arrangement gives excellent longitudinal and transverse dimensional stability.

According to a further feature of this invention the two weft yarns are laid in with the same lap. It is also possible in accordance with this invention to lap them opposite to each other. Both cases give excellent longitudinal and transverse dimensional stability. Being lapped in the same direction means that the guide bars for all of the weft filaments move in the same direction between needle reciprocations. When they are lapped against each other the guide bar for the one group of weft filaments moves in one direction and that for the other moves in the opposite direction. In sich a production method it is possible to form a slide-fastener stringer half using all the capacity of a modern knitting machine and obtaining an excellent product.

In other words, unlike the earlier system wherein the warp chains were each formed over a single needle position and and were not connected by any yarns apart from the inlaid weft, in the system of the invention the warp chains are formed as twill warps over two needles each so as to be interconnected in a twill pattern while the weft is subdivided into two groups. One of these groups has its yarns extending over three needles or wales while the other has its yarns lying each in a single wale. Thus the aforementioned desirable valleys (for receiving the needle threads of the double lock chain stitch) enabling the attachment of the coupling element are formed in spite of the twill pattern of the warp.

When "opposite" or "same" laps or inlaying directions are referred to herein, it whould be understood as the directions in which the yarns run as seen in projection on a plane of the tape. Thus oppositely lapped wefts are 180° offset from one another.

In accordance with yet another feature of this invention the yarns which are preferably all of the same approximate gauge or weight, are shrunk and thermofixed after knitting together of the tape. This provides an especially high density of yarn.

The new tape not only can make use of the considerable versatility of modern warp knitting machines in an effective manner but most surprisingly also permits sewing on of the coupling element more repidly with double lock chain stitching. The tape, moreover, imparts to the resulting slide fastener an especially high longitudinal stability and transverse stability sufficient to resist effectively all of the stresses which tend to alter the spacing of the coupling members of the coupling element in use.

BRIEF DESCRIPTION OF THE DRAWING

The above and other objects, features and advantages of the present invention will become more readily apparent from the following, reference being made to the accompanying drawing in which.

SPECIFIC DESCRIPTION

Figure 1:
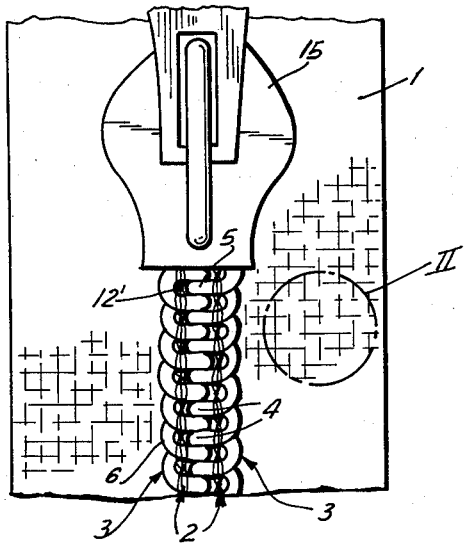
FIG. 1 is a top view of a portion of a slide-fastener stringer half according to this invention.
Figure 4:
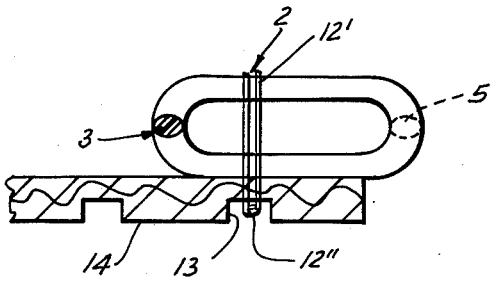
FIG. 4 is a diagrammatic section through the edge of a stringer half according to the invention.

The slide-fastener stringer shown in FIG. 1 has a pair of like warp-knitted support tapes 1 to whose juxtaposed edges are secured a pair of like monofilamentary coupling elements 3 by means of stitching 2. The elements 3 each comprise a succession of like helicoidal turns having parallel upper and lower shanks 4 lying in a plane perpendicular to the longitudinal direction of elongation of the elements 3, flattened coupling heads 5, and connecting bights 6 between adjacent turns.

The two shanks of each coupling member or "turn" have projections on the slide-fastener plane, i.e. the plane in which the tapes lie when the stringer is flat, which coincides or are congruent.

The heads 5 of each turn fit between the shanks 4 of the opposing turns for interleaving of the two coupling elements 3 and closing of the slide fastener by means of a slider 15. The stitching 2 is of the multithread chain stitch or double-lock stitch of class 400 (Federal standard 751*a*), preferably type 402 with a pair of looper threads 12′ extending downwardly through a respective tape 1 and a needle thread 12″ lying in a groove between a pair of adjacent wales as will be described below.

Figure 2:
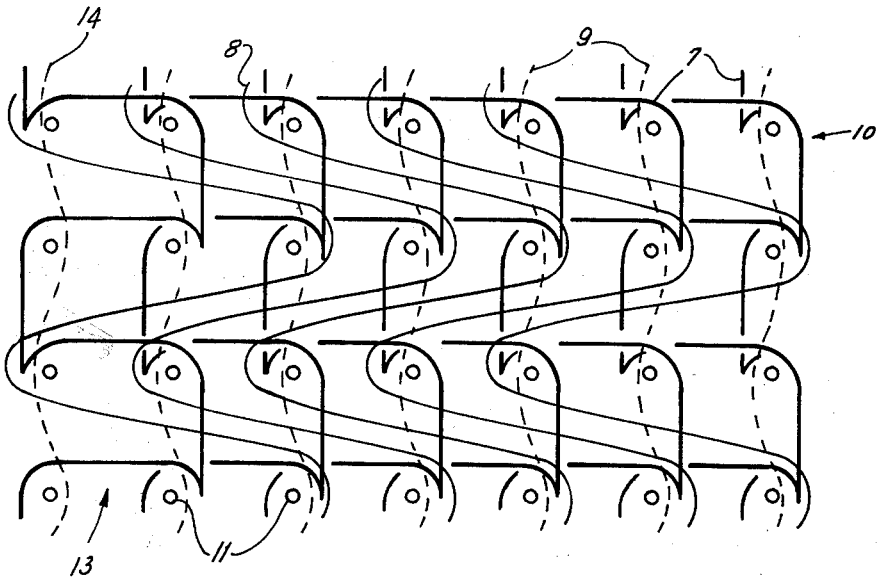
FIG. 2 is a diagrammatic view of the detail of FIG. 1 indicated by arrow II.
Figure 3:
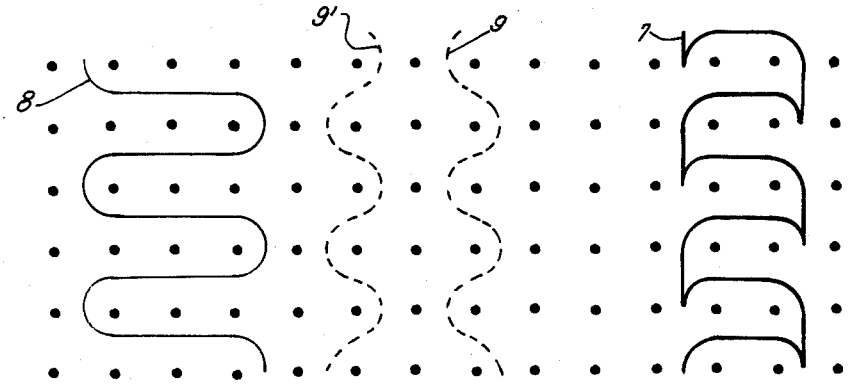
FIG. 3 is a point-paper diagram illustrating the pattern of various filaments forming the knit support tapes of the stringer of FIG. 1.

The tapes 1 are each knitted as shown in FIGS. 2 and 3. They are formed of warp yarns 7, first weft yarns 8, and second weft yarns 9. The warp yarns 7 form the wales 14 of the knit with an open loop at each course 10 thereof. Each of these filaments 7 form a longitudinally extending chain having a width extending over two needles or two wales. The weft filament 8 is laid in over three respective wales or needle rows and the weft filament 9 is laid in over a single wale or needle. Thus the yarn has the following pattern:

Warp yarns 7 — 0-0/2-0,
Weft yarn 8 — 3-3/0-0, and
Weft yarn 9 — 1-1/0-0.

Thus an extremely compact knit with excellent longitudinal and transverse dimensional stability is produced. The gap 13 between the end two wales 14 receives the needle threads 12 of the stitching 2 securing the element 3 to the tape 1.

FIG. 3 shows the weft yarn 9 running with the same lap as the weft yarn 8. It is also possible as shown at 9′ to lap the yarn in the opposite direction. This latter pattern is particularly suitable for forming spaces at the groove or valley 13 in order to receive the needle threads 12 of the stitching 2.

After knitting of the tape 1 it is heat-treated so as to shrink the synthetic-resin yarns and thermoset the tape 1. As shown in FIGS. 2 and 3 the yarns 7, 8 and 9 are all substantially the same gauge and weight. The dots 11 in FIG. 2 indicate the positions assumed by the needles each time they reciprocate relative to the surrounding yarn structures.

The tape according to the present invention has excellent dimensional stability and can be produced using the full capacity of a modern warp knitting machine. The fastener when secured to its with a double-chain stitch as described above will not be able to stretch relative to the tape 1 at all so that the good dimensional stability of these tapes will ensure that the slide fastener will operate for a long time.

I claim:

1. A slide-fastener stringer half comprising:
an elongated warp-knitted tape having a pair of opposite longitudinally extending edges and a pair of opposite faces and formed with a plurality of longitudinally extending parallel wales, said tape being knit exclusively with
a plurality of warp yarns each forming a respective longitudinally extending warp loop chain extending transversely over two respective wales with the warp loop chains each overlapping an adjacent warp loop chain at a common wale,
a first group of weft yarns laid into and each extending over three of said wales, and
a second group of weft yarns each laid into only one of said wales;
a continuous monofilamentary coupling element having a succession of turns and lying on one face of said tape along one edge thereof; and
stitching overlying said turns, extending through said tape, and having a needle thread on the other face of said tape between two of said wales at said edge.

2. The stringer half defined in claim 1 wherein said groups of weft yarns are laid in with the same lap.

3. The stringer half defined in claim 1 wherein said groups of weft yarns are laid in with opposite lap.

4. The stringer half defined in claim 1 wherein at least one of said yarns is shrunk.

5. The stringer half defined in claim 1 wherein said yarns are all of approximately the same gauge.

6. A method of making a slide-fastener stringer half comprising the steps of:
forming a plurality of warp yarns into a plurality of respective parallel and longitudinally extending warp loop chains each extending transversely over and forming two respective wales with the warp loop chains each overlapping an adjacent warp loop chain at a common wale;
laying a first group of weft yarns into said chains over three of said wales;
laying a second group of weft yarns each into the respective chains along only a respective one of said wales, whereby said yarns form a tape having a pair of opposite longitudinally extending edges and a pair of opposite faces;

thereafter juxtaposing a monofilamentary coupling element having a succession of turns with one of said faces at one of said edges; and thereafter stitching said element to said tape with stitching overlying said turns, passing through said tape, and lying on said other face of said tape between two of said wales at said edge.

7. The method defined in claim 6 wherein said second group is laid in with a lap opposite that of said first group.

8. The method defined in claim 6 wherein said second group is laid in with the same lap as said first group.

9. The method defined in claim 6 wherein one of said yarns is shrinkable, said method further comprising the step of shrinking said one yarn after the steps of forming a laying-in.

10. The method defined in claim 6 wherein said stitching is a multithread double lock stitch.

11. In a slide-fastener stringer having a pair of slide-fastener halves each with a knitted support tape and a continuous coupling element of synthetic resin monofilament whose coupling heads interdigitate with the coupling heads of the other coupling element upon movement of a slide therealong, each knitted tape having a warp and an inlaid weft defining valleys along the warp, and a row of double lock stitching connecting the respective coupling element with the tape and lying in one of the valleys, the improvement wherein:

the warp comprises a multiplicity of warp yarn in a twill pattern of warp loop chains each forming two wales with the warp loop chains each overlapping an adjacent warp loop chains each overlapping an adjacent warp loop chain at a common wale; and the weft comprises two groups of weft yarns, the yarns of one group extending over three wales, the yarns of the other group lying respectively each in only one of said wales, said warp yarns being in 0—0/2–0 pattern, said weft yarns of said one group being in 3—3/0—0 pattern and the weft yarns of said other group being in 1—1/0–0 pattern.

* * * * *